US008371397B2

(12) United States Patent
Roberts

(10) Patent No.: US 8,371,397 B2
(45) Date of Patent: Feb. 12, 2013

(54) FEED MECHANISM FOR DRILLING SYSTEMS

(75) Inventor: Neil James Roberts, Johannesburg (ZA)

(73) Assignee: Longyear TM, Inc., South Jordan, UT (US)

( * ) Notice: Subject to any disclaimer, the term of this patent is extended or adjusted under 35 U.S.C. 154(b) by 428 days.

(21) Appl. No.: 12/340,223

(22) Filed: Dec. 19, 2008

(65) Prior Publication Data

US 2010/0059280 A1 Mar. 11, 2010

Related U.S. Application Data

(60) Provisional application No. 61/094,551, filed on Sep. 5, 2008.

(51) Int. Cl.

| | |
|---|---|
| ***F16H 25/24*** | (2006.01) |
| ***B23Q 5/40*** | (2006.01) |
| ***B23B 47/18*** | (2006.01) |
| ***B23B 35/00*** | (2006.01) |
| ***E21B 12/00*** | (2006.01) |
| ***E21B 10/44*** | (2006.01) |
| ***E21B 4/00*** | (2006.01) |

(52) U.S. Cl. ..... 175/57; 175/122; 408/137; 408/1 R; 74/89.23

(58) Field of Classification Search ..... 175/57, 175/89, 108, 113, 121, 122; 173/37, 36, 173/34, 32; 403/203
See application file for complete search history.

(56) References Cited

U.S. PATENT DOCUMENTS

| | | | | |
|---|---|---|---|---|
| 246,440 | A * | 8/1881 | Aitken | 173/32 |
| 2,271,026 | A * | 1/1942 | Sinclair | 173/143 |
| 2,532,344 | A * | 12/1950 | Smith | 403/203 |
| 3,692,124 | A | 9/1972 | Kimber et al. | |
| 3,807,510 | A * | 4/1974 | Boom et al. | 173/160 |
| 3,980,144 | A | 9/1976 | Roos et al. | |
| 5,692,422 | A * | 12/1997 | Pierce | 82/113 |
| 7,032,684 | B2 | 4/2006 | Muuttonen et al. | |
| 2002/0144561 | A1 * | 10/2002 | Nagai et al. | 74/89.33 |

* cited by examiner

*Primary Examiner* — Kenneth L Thompson
*Assistant Examiner* — James Sayre
(74) *Attorney, Agent, or Firm* — Ballard Spahr LLP

(57) ABSTRACT

A cartridge feed screw nut includes a body having a tubular threaded opening defined therein and having side portions. The side portions include a plurality of lateral surfaces and a plurality of end surfaces. The lateral surfaces and the end surfaces form a profile shaped to prevent rotation of the cartridge feed screw nut relative to a front washer cylinder through engagement between at least one of the lateral surfaces or the end surfaces with the front washer cylinder.

24 Claims, 4 Drawing Sheets

FEED MECHANISM FOR DRILLING SYSTEMS

RELATED APPLICATIONS

The present invention claims the benefit of U.S. Provisional Patent Application Ser. No. 61/094,551 filed Sep. 5, 2008 and entitled "Feed Mechanism for Drilling Systems," the disclosure of which is hereby incorporated by reference in its entirety.

BACKGROUND OF THE INVENTION

1. The Field of the Invention

The present invention relates to drilling equipment and to rock drilling equipment in particular.

2. The Relevant Technology

Many drilling processes are currently known and used. One type of drilling process, referred to as rock drilling, often includes fracturing the rock with a bit to form holes. If desired, explosives can also be placed in the holes and used to break and fracture the rock further. One type of drill used in rock drilling is commonly known as a "drifter."

Drifters often include a cylindrical drilling mechanism (also known as a drifter cylinder) mounted to a slide frame. The drifter cylinder is often coupled to or includes a drive motor configured to generate percussive and/or rotational forces. The percussive and/or rotational forces are transmitted from the drifter cylinder to a drill bit.

Drifters also often include a feed screw secured to the slide frame and a feed screw nut assembly coupled to the drifter cylinder. The feed screw engages the feed screw nut assembly in such a manner that rotation of the feed screw results in translation of the feed screw nut assembly, and consequently the drifter cylinder, relative to the slide frame. Currently, feed screw nut assemblies often include a front cylinder washer secured to the drifter cylinder. The front cylinder washer provides a housing for a feed screw nut that includes the threads or other features that engage the feed screw. The feed screw nut is often pressed into the front cylinder washer with an interference fit. A feed screw nut further secures the feed screw nut to the front cylinder washer and thus to the drifter cylinder. In such a configuration, as the feed screw rotates, the feed screw nut translates along the relatively stationary feed screw and slide frame.

For example, the drifter cylinder is often advanced relative to the slide frame to move the drill bit into contact with a formation. The feed screw can continue to rotate the drifter cylinder to maintain pressure on the drill bit as the drifter cylinder applies a percussive and/or rotational force to thereby fracture the formation and form a hole therein. Forces between the feed screw and the feed screw nut assembly can cause the feed screw nut to wear over time. This wear can be hastened by the presence of debris and/or grit falling onto the rock drill and into the feed screw nut assembly during drilling operations. Eventually, the feed screw nut assembly can wear out after which it is replaced.

Conventionally, the feed screw nut assembly is replaced by unthreading the feed screw nut from the feed screw nut. Any washers on the feed screw nut are also removed. Thereafter, the feed screw nut is freed from the front cylinder washer by tapping the feed screw nut from the front cylinder washer. A new feed screw nut is then pressed into place in the front cylinder washer and a feed screw nut is then rotated onto the feed screw nut to secure the entire feed screw nut assembly to the front cylinder washer. While such a configuration can provide a replaceable feed screw nut assembly, replacement of the feed screw nut assembly can be time consuming and difficult given the tight space between the feed screw nut assembly and the slide frame. These difficulties can be heightened due to the overall conditions present during rock drilling operations, such as in underground environments.

The subject matter claimed herein is not limited to embodiments that solve any disadvantages or that operate only in environments such as those described above. Rather, this background is only provided to illustrate one exemplary technology area where some embodiments described herein may be practiced

SUMMARY

A cartridge feed screw nut includes a body having a tubular threaded opening defined therein and having side portions. The side portions include a plurality of lateral surfaces and a plurality of end surfaces. The lateral surfaces and the end surfaces form a profile shaped to prevent rotation of the cartridge feed screw nut relative to a front washer cylinder through engagement between at least one of the lateral surfaces or the end surfaces with the front washer cylinder.

A drilling assembly, can include a front washer cylinder having a recess defined therein having a front washer cylinder profile, and a cartridge feed screw nut having a tubular threaded opening defined therein. The tubular threaded opening has a longitudinal axis, wherein the cartridge feed screw nut has a nut profile. The nut profile can be complimentary to allow the cartridge feed screw nut to be received within the recess in the front washer cylinder.

A rock drill includes a cartridge feed screw nut and a front cylinder washer. The cartridge feed screw nut and a recess defined in the front cylinder washer have complimentary shapes configured to allow the cartridge feed screw nut to be at least partially received in the front cylinder washer in such a manner that geometrical engagement between the front cylinder washer and the cartridge feed washer prevents rotation of the front cylinder washer relative to the front cylinder washer.

A method of drilling can include coupling a cartridge feed screw nut to a front cylinder washer in which the cartridge feed screw nut has a tubular threaded opening defined therein. The tubular threaded opening has a longitudinal axis and the front cylinder washer has a recess defined therein. Coupling the cartridge feed screw nut to the front cylinder washer includes moving the cartridge feed screw nut in a direction that is at an acute angle relative to the longitudinal axis.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figure 1:
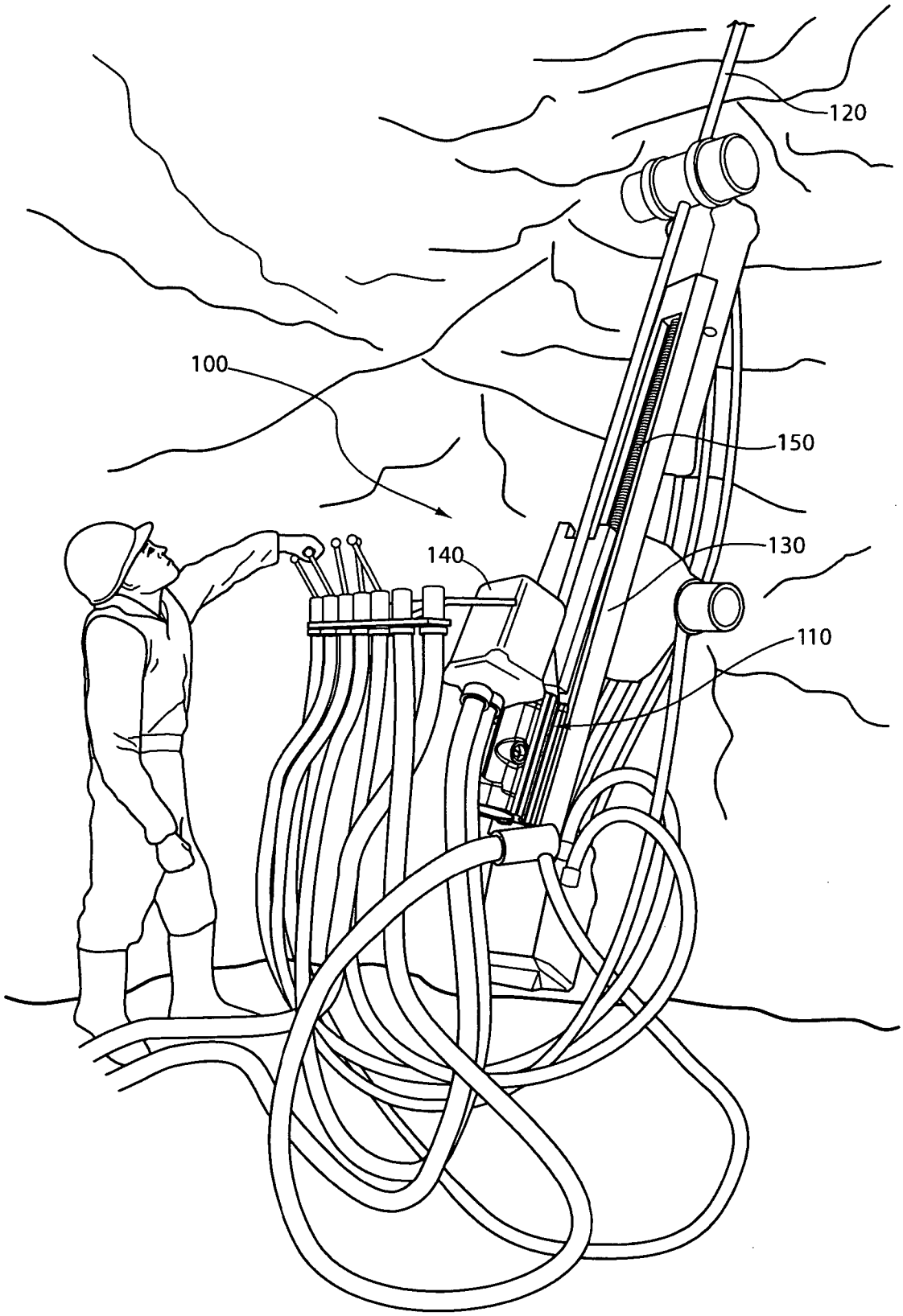
FIG. 1 illustrates a drilling system according to one example.

Together with the following description, the figures demonstrate non-limiting features of exemplary devices and methods. The thickness and configuration of components can be exaggerated in the figures for clarity. The same reference numerals in different drawings represent similar, though not necessarily identical, elements.

DETAILED DESCRIPTION OF THE PREFERRED EMBODIMENTS

Drilling systems and replaceable cartridge feed screw nut assemblies are provided herein. In at least one example, a feed screw nut assembly includes a cartridge feed screw nut, a front cylinder washer, and a locking pin. The cartridge feed screw nut includes a tubular, threaded opening extending therethrough that is configured to engage a feed screw. A longitudinal axis passes generally through the tubular threaded opening. Accordingly, engagement between a feed screw and the feed screw nut assembly causes translation along the longitudinal axis.

The front cylinder washer has a recess defined therein. The recess in the front cylinder washer and the cartridge feed screw nut have complimentary shapes such that geometrical engagement between the two reduces or eliminates rotation of the cartridge feed screw nut relative to the front cylinder washer. In at least one example, the complimentary shapes of the cartridge feed screw nut and the recess in the front washer cylinder can be described as a tenon and mortise configuration. In at least one example, when viewed from below, the cartridge feed screw nut has two surfaces that intersect at an angle.

Any number of complimentary shapes can be provided. In at least one example, the cartridge feed screw nut includes a body having at least opposing side surfaces, opposing end surfaces, a top surface, and a bottom surface. The opposing side surfaces can be generally planar. Further, at least part of the planar portion of the opposing sides can also be generally parallel. Similarly, at least a portion of the opposing end surfaces can also be generally planar and/or generally parallel to each other. In at least one example, the planar portions can be oriented to form a generally rectangular profile when viewed from above or below.

The cartridge feed screw nut and front cylinder washer include pin holes defined therein that are at least partially aligned when the cartridge feed screw nut is positioned relative to the front cylinder washer. When the pin holes are thus aligned, the locking pin can be pushed through at least a portion of the front cylinder washer and into engagement with the cartridge feed screw nut to thereby secure the cartridge feed screw nut in position relative to the front cylinder washer. The tenon and mortise configuration of the cartridge feed screw nut and the front cylinder washer can allow the cartridge feed screw nut to be rapidly fitted to the front cylinder washer. The cartridge feed screw nut can then be rapidly secured in position with the locking pin. The cartridge feed screw nut can also be rapidly removed and a new cartridge feed screw nut fitted to the front cylinder washer. One exemplary cartridge feed screw nut and front cylinder washer assembly will be described in more detail below.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on drifter cylinders in pneumatic drifter rock drill operations, the apparatus and associated methods could be equally applied to other processes such as hydraulic drifter rock drilling, various percussive drilling processes, and the like.

FIG. 1 illustrates a drilling system 100 according to one example. As illustrated in FIG. 1, the drilling system 100 includes a drifter cylinder 110, a drill rod 120, a slide frame 130, and a drive mechanism 140. The drifter rock drill 100 may be used for drilling holes into rock formations or other hard formations in the earth. The holes may then be used to create fractures in the rock formation with explosives or with other means to allow removal of the fractured rock.

As shown in FIG. 1, the drifter cylinder 110 rests on the slide frame 130. The drilling system 100 can rotate the drill rod 120 within drifter cylinder 110 and/or transmit a percussive motion to the drifter cylinder 110 and the drill rod 120. In at least one example, the rotational and percussive forces can be applied independently. The drive mechanism 140 can include a feed screw 150 mounted to the slide frame 130. The feed screw 150 engages a cartridge feed screw nut 200 (FIG. 2) that is coupled to the drifter cylinder 110. As the feed screw 150 rotates, the feed screw nut assembly 200 (FIG. 2) translates along the feed screw 150 and relative to the slide frame 130 in the desired direction.

Figure 2A:
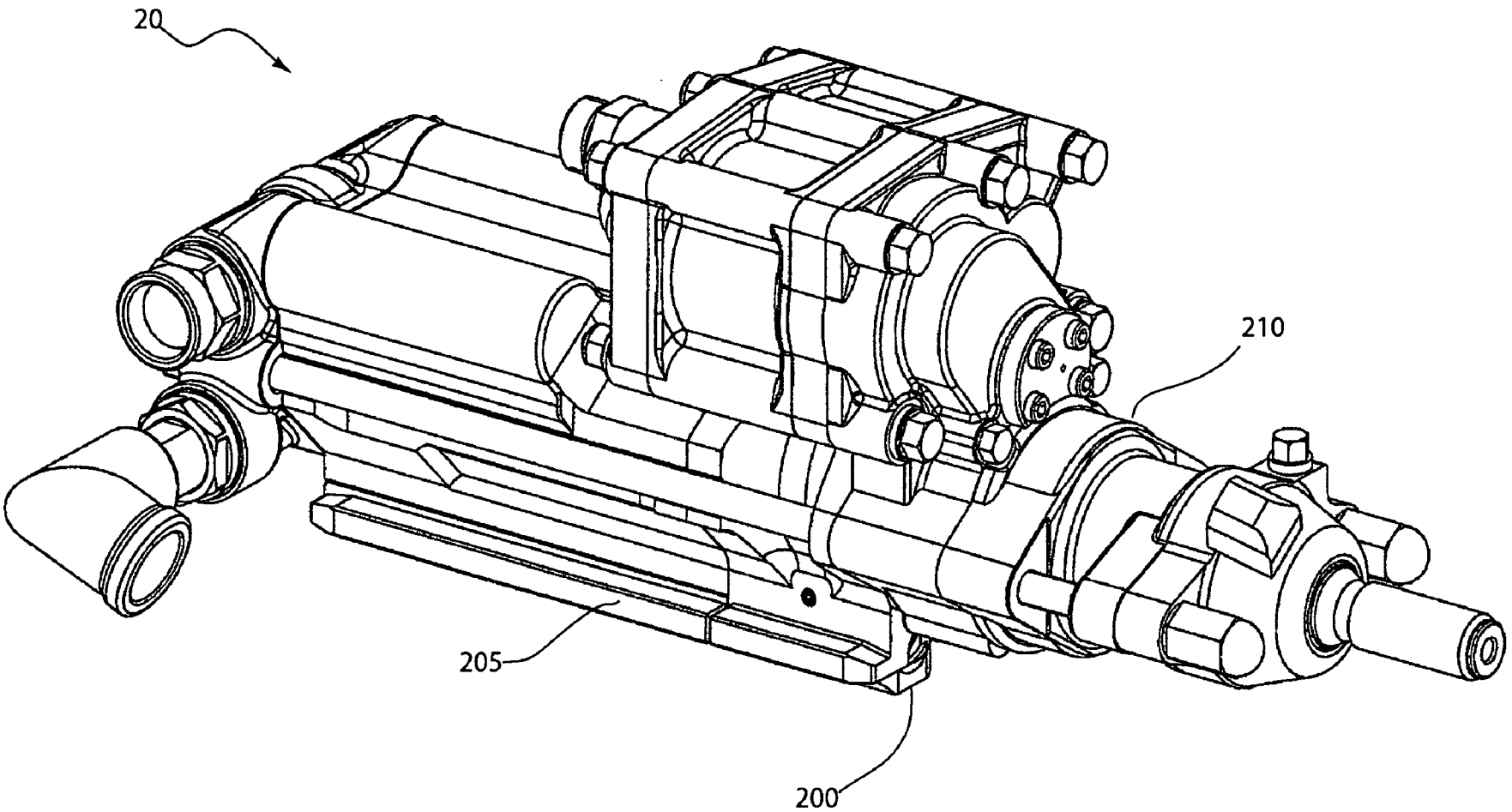
FIG. 2A illustrates a top perspective view of a rock drill according to one example.

FIG. 2A illustrates a top partial perspective view of a rock drill 20 according to one example. The rock drill 20 is shown separate from a feed screw (such as 150, FIG. 1) and a slide frame (such as 130, FIG. 2). The rock drill 20 further includes feet 205 and a drifter cylinder 210. As illustrated in FIG. 2A, in at least one example a cartridge feed screw nut 200 can be secured to a lower portion of the drifter cylinder 210. The cartridge feed screw nut 200 allows the drifter cylinder 210 to translate as a feed screw rotates while the feet 205 guide the drifter cylinder 210 along a slide frame.

Figure 2B:
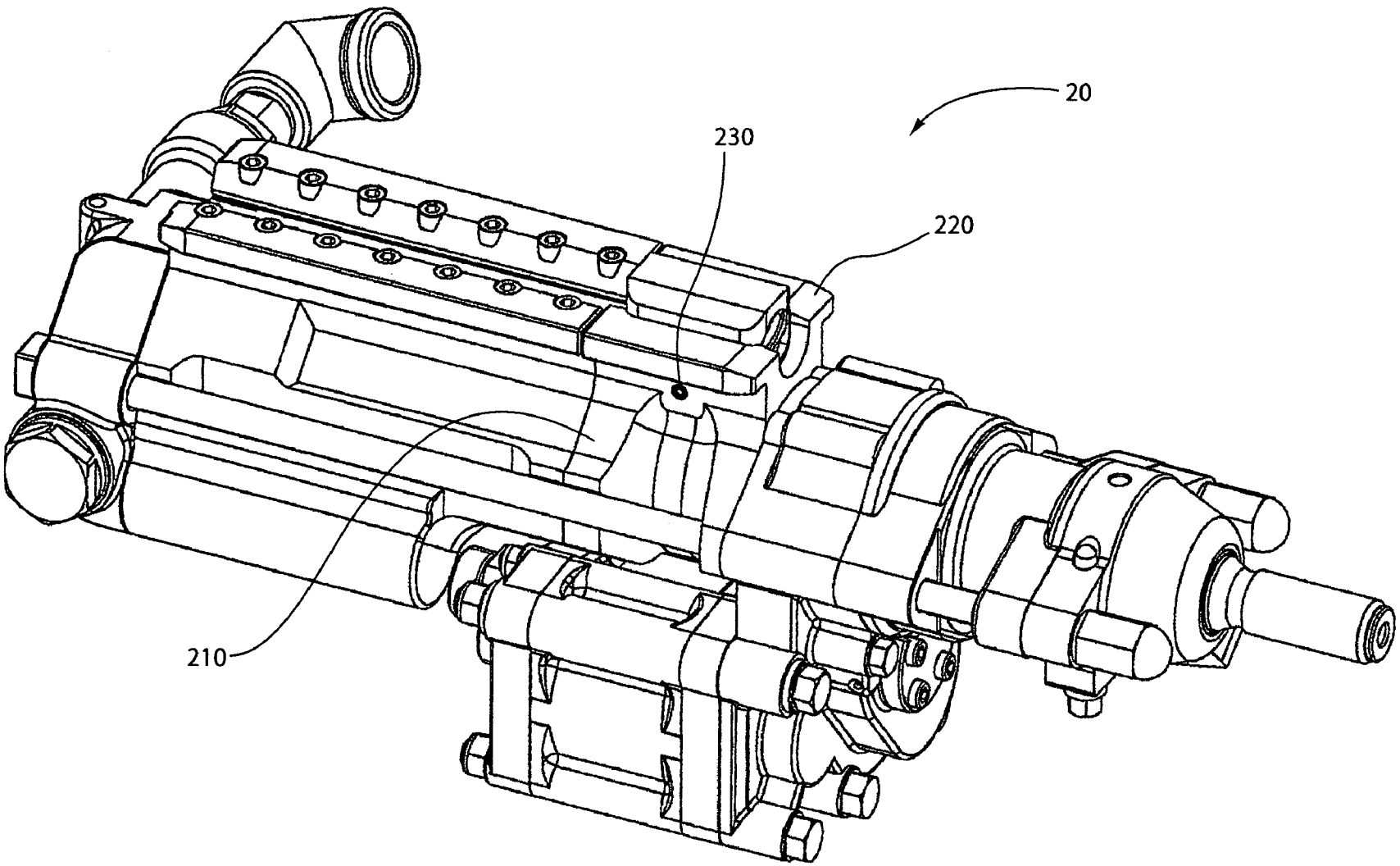
FIG. 2B illustrates a bottom perspective view of a rock drill according to one example.

FIG. 2B illustrates a bottom perspective view of the rock drill 20 according to one example. As illustrated in FIG. 2B, the rock drill 20 includes the drifter cylinder 210. The drifter cylinder 210 includes and/or has a front cylinder washer 220 coupled thereto. In at least one example the front cylinder washer 220 can be integrally formed with the drifter cylinder 210 while in other examples the front cylinder washer 220 can be formed separately and secured to the drifter cylinder 210.

Figure 2C:
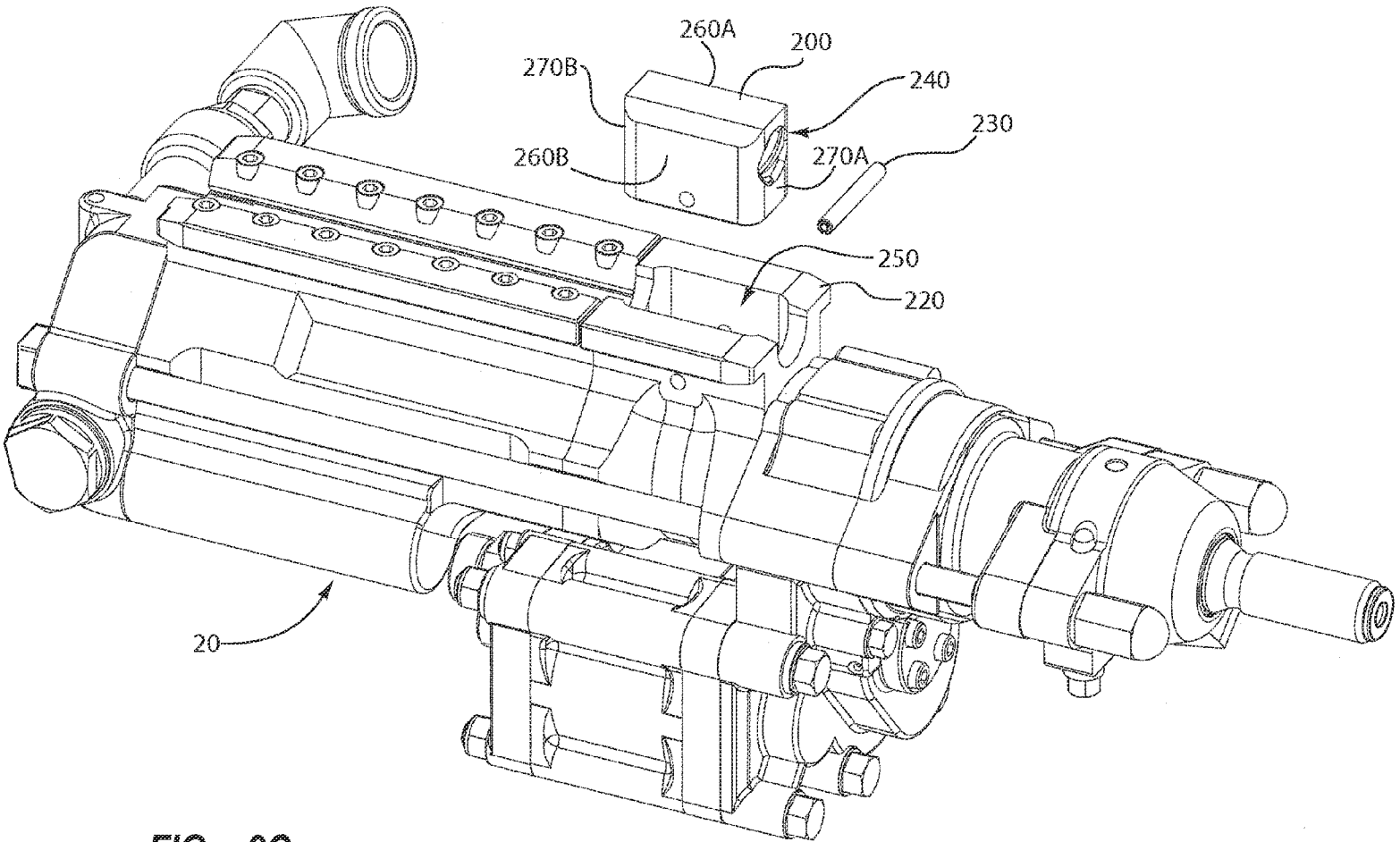
FIG. 2C illustrates an exploded perspective view of a cartridge feed screw nut and front cylinder washer assembly according to one example.

The rock drill 20 also includes the replaceable cartridge feed screw nut 200. In the illustrated example, the cartridge feed screw nut 200 has a tenon configuration that is configured to be positioned at least partially within a mortise that includes a correspondingly shaped recess defined in the front cylinder washer 220. As illustrated in FIG. 2C, the cartridge feed screw nut 200 can be secured in place relative to the front cylinder washer 220 with a locking pin 230 or other retention device or structure.

FIG. 2C illustrates an exploded perspective view of the cartridge feed screw nut 200 and front cylinder washer 220 according to one example. As illustrated in FIG. 2C, the cartridge feed screw nut 200 can include a threaded tubular opening 240 defined therein. The threaded tubular opening 240 is configured to engage a drive screw to move the drifter cylinder 210 when the cartridge feed screw nut 200 is positioned within the front cylinder washer 220.

In at least one example, the front cylinder washer 220 includes a recess 250 defined therein. The recess 250 can have a complimentary shape of the cartridge feed screw nut 200. Such a configuration can provide a mortise and tenon relationship between the two such that geometric engagement between one or more of the surfaces on the cartridge feed screw nut 200 reduce or prevent rotation of the cartridge feed screw nut 200 and the front cylinder washer 220. In particular, a direction in which the cartridge feed screw nut 200 is advanced to move the cartridge feed screw nut 200 into engagement with the front cylinder washer 220 (or coupling direction) can be a generally acute angle relative to the longitudinal axis of the drifter cylinder 210 as measured from a line that is perpendicular to the longitudinal axis. In other examples, the line of movement can be obtuse. Geometric engagement between the cartridge feed screw nut 200 and the front cylinder washer 220 can reduce or prevent rotation of the cartridge feed screw nut 200 relative to a plane transverse to a plane that includes the coupling direction and the longitudinal axis.

FIG. 2C also illustrates a first step for operating a drilling system. In particular, a first step can include coupling the cartridge feed screw nut 200 to the front cylinder washer 220 and then moving the locking pin 230 to secure the feed screw nut 200 to the front cylinder washer 200. In at least one example, coupling the cartridge feed screw nut 200 to the front cylinder washer 220 includes moving the cartridge feed screw nut 200 in a direction that is at an acute angle relative to the longitudinal axis. The resulting configuration is the assembled configuration shown in FIG. 2B. The rock drill can then be operated as desired.

At some point, it may be desirable to replace the cartridge feed screw nut 200. Replacing the cartridge feed screw nut 200 can include removing the cartridge feed screw nut 200. In at least one example, removing the cartridge feed screw nut 200 can include removing the locking pin 230 from engagement with the front cylinder washer 220 and the cartridge feed screw nut 200. This can be accomplished by tapping the locking pin 230 out with a suitably sized punch. The locking pin 230 can also be removed from engagement with the front cylinder washer 220 and the cartridge feed screw nut 200 in any manner desired. In at least one example, removing the cartridge feed screw nut 200 from the front cylinder washer 220 includes moving the cartridge feed screw nut 200 in a direction that is at an acute angle relative to the longitudinal axis.

Once the locking pin 230 has been removed, the cartridge feed screw nut 200 can be pulled from the front cylinder washer 220. Pulling the cartridge feed screw nut 200 can include moving the cartridge feed screw nut 200 in a direction that is transverse to an axis defined through a threaded tubular opening 240 of the cartridge feed screw nut 200. In at least one direction, this can be away from a centerline of the rock drill 20 rather than parallel to the centerline of the rock drill 20. Thereafter, a new cartridge feed screw nut 200 can be refitted to the rock drill 20. Refitting can be accomplished by moving the cartridge feed screw nut 200 in the opposite direction as pulling the cartridge feed screw nut 200.

Accordingly, as illustrated in FIG. 2C, refitting the cartridge-style feed screw nut 200 can include cleaning the recess 250 defined in the front cylinder washer 220. In at least one example refitting the cartridge feed screw nut 200 can further include applying a lubricant such as a grease to the front cylinder washer and/or the cartridge feed screw nut. In at least one example, this grease or lubricant can include a metallic-filled grease, such as a copper-filled grease. Thereafter the new cartridge feed screw nut 200 can be fitted to the front cylinder washer 220.

Refitting of the cartridge feed screw nut 200 can also include positioning the feed screw nut 200 relative to the front cylinder washer 220 and securing the feed screw nut 200 in place by passing the locking pin 230 through at least a portion of the front cylinder washer 220 and into engagement with the cartridge feed screw nut 200.

As illustrated in FIG. 2C, the cartridge feed screw nut 200 includes at least two opposing surfaces, such as lateral surfaces 260A, 260B. The cartridge feed screw nut 200 can further include additional opposing surfaces, such as opposing end surfaces 270A, 270B. As viewed from above, the lateral surfaces 260A, 260B and the opposing end surfaces 270A, 270B form a profile that is complimentary to the profile of the recess 250 defined in the front cylinder washer 220. The profiles associated with cartridge feed screw nut 200 and the front cylinder washer 220 can have any shape that reduces or prevents rotation of the cartridge feed screw nut 200 relative to the front cylinder washer 220 due to engagement between any number of the lateral surfaces 260A, 260B and the end surfaces 270A, 270B with the front cylinder washer 220. For example, in at least one example the intersection between planes containing the lateral surfaces 260A, 260B and either or both of the end surfaces 270A, 270B intersect an acute angle and/or at a right angle. In the illustrated example, the end surfaces 270A, 270B and/or the lateral surface 260A, 260B can be generally planar and also be parallel. Further, the lateral surfaces 260A, 260B can be generally parallel to an axis of the tubular threaded opening 240. Accordingly, in at least one example, the intersection of at least one of these surfaces can be generally perpendicular.

In at least one example, either or both of the transitions between the lateral surface 260B and end surfaces 270A, 270B can be different than the transitions between lateral surface 260A and the end surfaces 270A, 270B. Such a configuration can help ensure proper alignment between the front cylinder washer 220 and the cartridge feed screw nut 200 by providing a unique fit between the two.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A cartridge feed screw nut for engaging a feed screw of a drilling system, the drilling system comprising a drill having a drifter cylinder and a front cylinder washer secured to the drifter cylinder, the front cylinder washer defining a recess, the cartridge feed screw nut comprising:

a body having a tubular threaded opening defined therein, the tubular threaded opening having a longitudinal axis and being adapted to directly threadingly engage the feed screw, the body also having side portions including:

a plurality of lateral surfaces including a first lateral surface and a second lateral surface, a plurality of end surfaces, wherein the lateral surfaces and the end surfaces form a profile of the body, the profile being shaped for complementary receipt within the recess of the front cylinder washer, wherein, following receipt of the cartridge feed screw nut within the recess of the front cylinder washer, the profile of the body is configured to prevent rotation of the cartridge feed screw nut relative to the front cylinder washer through engagement between at least one of the lateral surfaces or the end surfaces of the body and the front cylinder washer; and a pin hole extending through the body from the first lateral surface to the second lateral surface, the pin hole being spaced from the tubular threaded opening of the body and being generally transverse to the longitudinal axis of the tubular threaded opening of the body, the pin hole being adapted to receive a locking pin such that the cartridge feed screw nut is secured in place relative to the front cylinder washer.

2. The feed screw nut of claim 1, wherein the first and second lateral surfaces are parallel, and wherein the longitudinal axis of the tubular threaded opening is substantially parallel to the first and second lateral surfaces.

3. The feed screw nut of claim 1, wherein the profile of the body is asymmetric about the longitudinal axis of the tubular threaded opening.

4. The feed screw nut of claim 1, wherein the end surfaces of the body are parallel.

5. The feed screw nut of claim 1, wherein the profile of the body is generally rectangular.

6. The feed screw nut of claim 5, wherein at least one corner of the rectangular profile of the body is rounded.

7. A drilling assembly, comprising:

a front cylinder washer having a first wall, a second wall, and a recess defined therebetween, the recess having a first geometry, the first and second walls defining first and second pin holes;

a cartridge feed screw nut having a tubular threaded opening defined therein, the tubular threaded opening being adapted to directly threadingly engage a feed screw of drilling system, the tubular threaded opening having a longitudinal axis, wherein the cartridge feed screw nut has a geometry that is complementary to the first geometry of the recess to allow the cartridge feed screw nut to be received and rotationally locked within the recess in the front cylinder washer, the cartridge feed screw nut further defining a third pin hole extending there through, and a locking pin extending into the first pin hole, through the third pin hole and into the second pin hole thereby releasably locking the cartridge feed screw nut to the front cylinder washer.

8. The assembly of claim 7, further comprising a drifter cylinder, wherein the front cylinder washer is coupled to the drifter cylinder.

9. The assembly of claim 7, further comprising a drifter cylinder, wherein the front cylinder washer is integral to the drifter cylinder.

10. The assembly of claim 7, wherein the third pin hole is generally perpendicular to the tubular threaded opening of the cartridge feed screw nut.

11. The assembly of claim 7, wherein the locking pin has opposed first and second ends, and wherein both ends of the locking pin are accessible when the locking pin is secured within the first, second, and third pin holes.

12. The assembly of claim 7, wherein the cartridge feed screw nut includes a body having a plurality of lateral surfaces and a plurality of end surfaces, wherein the lateral surfaces and the end surfaces of the cartridge feed screw nut form a nut profile, the nut profile being shaped to prevent rotation of the cartridge feed screw nut relative to the front cylinder washer through engagement between at least one of the lateral surfaces and the end surfaces with the front cylinder washer.

13. The assembly of claim 12, wherein the lateral surfaces of the body of the cartridge feed screw nut are parallel.

14. The assembly of claim 12, wherein the tubular threaded opening of the cartridge feed screw nut is parallel to the lateral surfaces of the body of the cartridge feed screw nut.

15. The assembly of claim 12, wherein the end surfaces of the body of the cartridge feed screw nut are parallel.

16. The assembly of claim 12, wherein said plurality of lateral surfaces of the body of the cartridge feed screw nut have a length longer than the depth of the recess of the front washer cylinder.

17. A rock drill, comprising:

a feed screw;

a cartridge feed screw nut defining a tubular threaded opening configured to threadingly receive the feed screw, the tubular threaded opening having a longitudinal axis, the cartridge feed screw nut further defining a pin hole extending completely through the cartridge feed screw nut and spaced from the tubular threaded opening, the pin hole of the cartridge feed screw nut being generally transverse to the longitudinal axis of the tubular threaded opening;

a drifter cylinder;

a front cylinder washer secured to the drifter cylinder, the front cylinder washer defining a recess; and a locking pin extending completely through the pin hole of the cartridge feed screw nut and into the front cylinder washer such that the cartridge feed screw nut is secured in place relative to the front cylinder washer;

wherein the cartridge feed screw nut and the recess defined in the front cylinder washer have complementary shapes configured to allow the cartridge feed screw nut to be at least partially received in the front cylinder washer, wherein, upon receipt of the cartridge feed screw nut within the recess of the front cylinder washer, geometrical engagement between the front cylinder washer and the cartridge feed screw nut prevents rotation of the cartridge feed screw nut relative to the front cylinder washer.

18. The rock drill of claim 17, wherein the front cylinder washer is securely coupled to the drifter cylinder.

19. The rock drill of claim 17, wherein the front cylinder washer is integral to the drifter cylinder.

20. The rock drill of claim 17, wherein the locking pin has opposed first and second ends, and wherein both ends of the locking pin are accessible when secured to the cartridge feed screw nut and the front washer cylinder.

21. A method of drilling, comprising:

providing a cartridge feed screw nut, the cartridge feed screw nut having a tubular threaded opening defined therein, the tubular threaded opening having a longitudinal axis and the front cylinder washer having a recess defined therein;

inserting the cartridge feed screw nut into a recess defined in a front cylinder washer, the recess and the cartridge feed screw nut having complementary shapes configured to allow the cartridge feed screw nut to be at least partially received in the recess in a manner that geometrical engagement between the front cylinder washer and the cartridge feed screw nut prevents rotation of the cartridge feed screw nut relative to the front cylinder washer;

inserting a locking pin into the front cylinder washer and the cartridge feed screw nut whereby the locking pin extends through a portion of the front cylinder washer on a first side of the recess, completely through the cartridge feed screw nut, and into a second portion of the front cylinder washer on an opposing side of the recess;

threading a feed screw directly into the tubular threaded opening of the cartridge feed screw nut; and rotating the feed screw thereby causing the cartridge feed screw nut to advance along the feed screw.

22. The method of claim 21, further comprising securing the cartridge feed screw nut to the front cylinder washer with the locking pin.

23. The method of claim 22, further comprising removing the cartridge feed screw nut by moving the cartridge feed screw nut laterally of the recess of the front cylinder washer in a direction generally perpendicular to the feed screw longitudinal axis of the tubular threaded opening.

24. The method of claim 23, further comprising replacing the cartridge feed screw nut by moving the cartridge feed screw nut in a direction generally perpendicular to the longitudinal axis of the tubular threaded opening into the recess of the front cylinder washer.

* * * * *